United States Patent [19]

Franzmann

[11] 4,137,812

[45] Feb. 6, 1979

[54] DEVICE FOR CONTINUOUS PITCH VARIATION OF STRINGED INSTRUMENTS

[76] Inventor: Rainer Franzmann, Mittelstrasse 24, 2000 Norderstedt 2, Fed. Rep. of Germany

[21] Appl. No.: 821,971

[22] Filed: Aug. 4, 1977

Related U.S. Application Data

[63] Continuation-in-part of Ser. No. 613,803, Sep. 16, 1975, Pat. No. 4,044,645.

[30] Foreign Application Priority Data

Oct. 8, 1976 [DE] Fed. Rep. of Germany ..... 2635905
Apr. 2, 1977 [DE] Fed. Rep. of Germany ..... 2704636
Apr. 2, 1977 [DE] Fed. Rep. of Germany ..... 2704637

[51] Int. Cl.[2] ..... G10D 3/00
[52] U.S. Cl. ..... 84/313
[58] Field of Search ..... 84/267, 293, 312, 313

[56] References Cited

U.S. PATENT DOCUMENTS 3,185,011 5/1965 Anderson ..... 84/313 X
3,580,124 5/1971 Mancini ..... 84/313
4,044,645 8/1977 Franzmann ..... 84/313

FOREIGN PATENT DOCUMENTS 1597028 3/1970 Fed. Rep. of Germany ..... 84/293

*Primary Examiner*—Lawrence R. Franklin
*Attorney, Agent, or Firm*—Stonebraker, Shepard & Stephens

[57] ABSTRACT

A device for continuous pitch variation has rotary support levers which connect the extension piece of the neck flexibly with the body of the instrument. A rotary string holder is mounted on the extension piece of the neck and a ribbon connects the string holder with one of the rotary support levers (via a roller). A tension spring connects one of the rotary support levers with the extension piece of the neck or as a second possibility with the body of the instrument. A counterweight is mounted on another rotary support lever which is so connected with the extension piece of the neck or one of its support levers that, when sliding the neck, an opposite movement of the counterweight will be effected. A locking or stop device gives the player the possibility to lock or to open the mobility of the neck.

7 Claims, 5 Drawing Figures

DEVICE FOR CONTINUOUS PITCH VARIATION OF STRINGED INSTRUMENTS

CROSS REFERENCE TO RELATED APPLICATION

This is a continuation-in-part of my application Ser. No. 613,803, filed Sept. 16, 1975, now U.S. Pat. No. 4,044,645.

SUMMARY OF THE INVENTION

This application relates to devices for continuous pitch variation of stringed instruments by which the neck can be slid relative to the body of the instrument whereby the tension of the strings is changed by means of a special mechanical device. Such devices have been described in the German Pat. No. 15 97 028, and the German patent applications Nos. 24 45 181, 25 07 285 and the American patent application Ser. No. 613 803, now U.S. Pat. No. 4,044,645. One of the objects of the invention is to provide a device for continuous pitch variation in which sturdy support levers have a very long effective lever arm, are easy to move, and allow a thin or flat proportioning of the body, of the instrument.

Another object of the invention is to provide a device for continuous pitch variation in which the holding means of the stringholder render possible different lever arms of the strings, so that the different degrees of tension and stretching of the strings can be compensated, and a good tuning is guaranteed, when sliding the neck.

Another object of the invention is to provide a device for continuous pitch variation in which the weight of the neck and its mechanical means are compensated by a counterweight in such a manner that any uncontrolled self-acting of the neck, caused by its own weight, is prevented.

Another object of the invention is to provide a device for continuous pitch variation in which the player can stop and open the mobility of the neck when playing, so that the sound of a normal instrument with a fixed neck or the sound effects of a sliding neck can be produced just as wanted.

These and further objects and advantages of this invention will become apparent from the following description and drawings, taken together with the claims.

DETAILED DESCRIPTION OF THE PREFERRED EMBODIMENTS.

The drawings show a special application of the invention, in this case an electric guitar. An electric bass could also be a preferred application of the invention.

The shown components of the device are preferably made of metal. Light metal is used where the firmness or stability of the material is sufficient.

Figure 1:
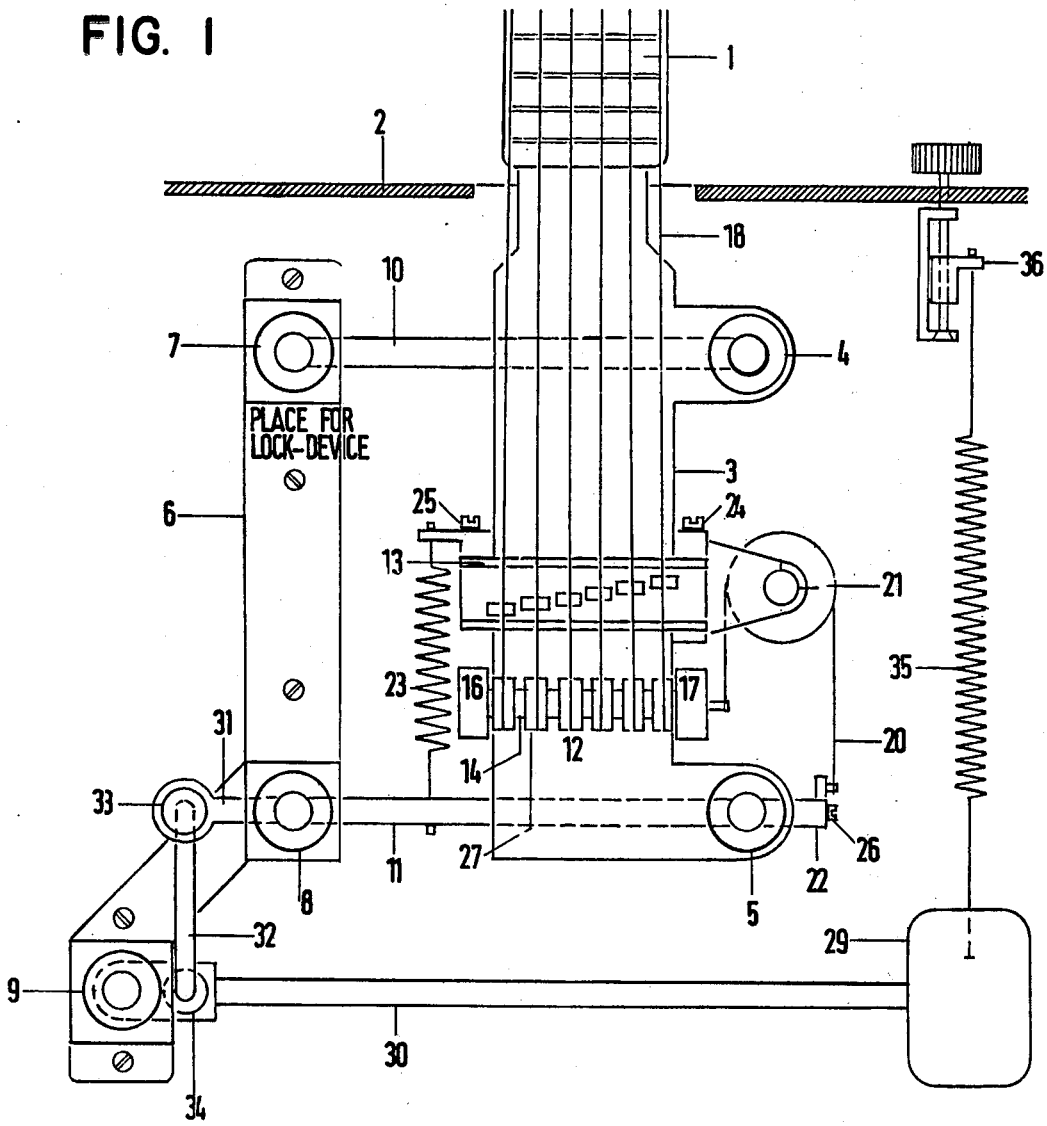
FIG. 1 is a top plan view of the device for continuous pitch variation.
Figure 2:
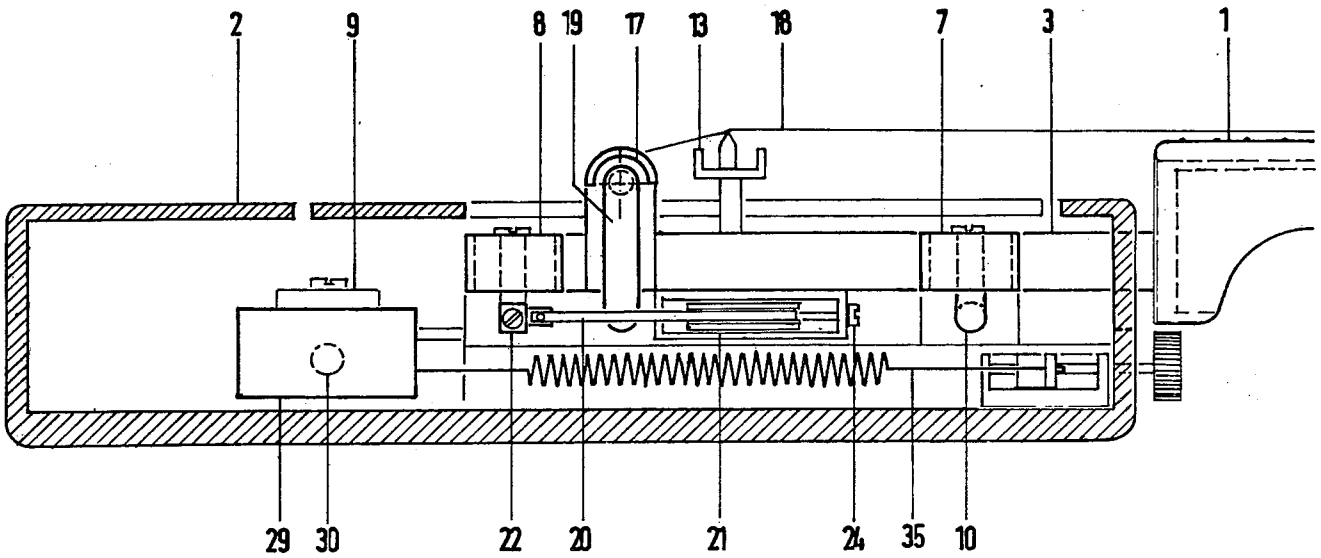
FIG. 2 is a right side elevational view of the device.
Figure 3:
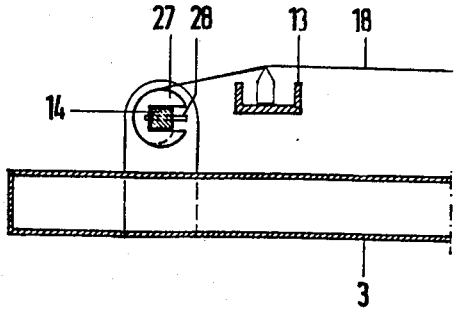
FIG. 3 is a schematic cross section through the stringholder.
Figure 4:
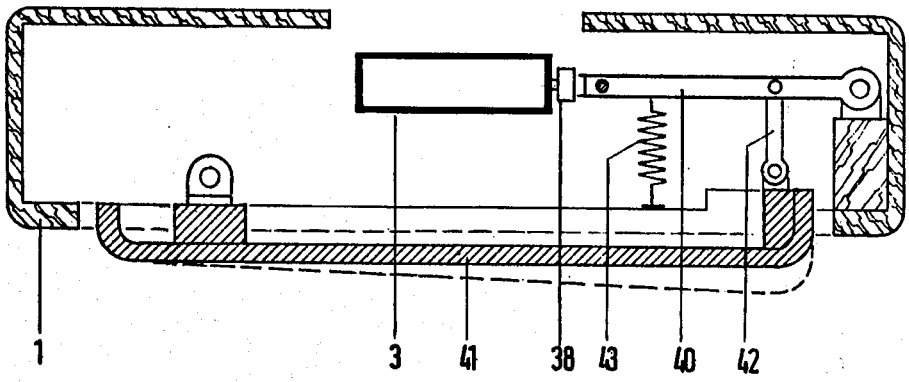
FIG. 4 is a schematic cross section through the lock-device.
Figure 5:
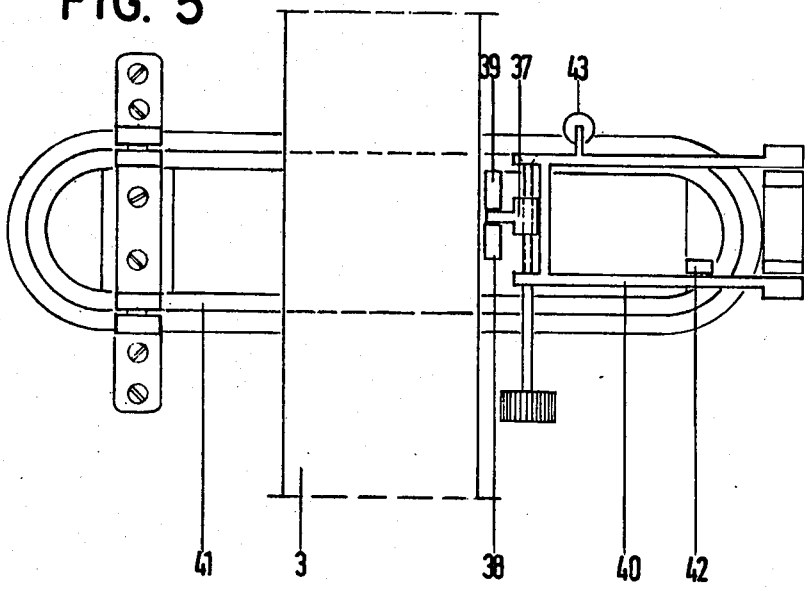
FIG. 5 is a top plan view of the lock-device.

FIG. 1 shows a guitar with its neck 1 and its body 2. The neck 1 is lengthened by the extension piece 3. The extension piece has two bearings 4 and 5, preferably constructed as ball-bearings. The bar 6 which is fixed on the bottom of the body 2 has three bearings 7, 8 and 9. These bearings are also preferably constructed as ball-bearings, so that the frictional resistance will be as small as possible. The support levers 10 and 11, mounted with pegs or pins into the bearings 4,5 and 7,8, connect the extension piece 3 flexibly with the body 2. Their moving plane is parallel to the bottom of the body 2. The great distance of the pivots of the bearings 4 to 7 and 5 to 8 provide long lever arms of the support levers, which are necessary for an easy sliding of the neck, for changing the tension of strings with a small sliding force.

The parallel-to-the-bottom-arrangement of the support levers 10 and 11 provides a most thin proportioning of the body 2. The arrangement shows an excellent hanging of the slidable neck when the instrument is held in the usual playing posture. The stringholder 12 is mounted on the extension piece of the neck 3 beyond the bridge 13. It consists of an axle 14 which is pivoted and mounted in the bearings 16 and 17. These bearings are also preferably constructed as ball-bearings. The strings 18 are fixed on the axle 14. One end of the axle 14 has a lever 19. From this lever 19 a ribbon 20 is assembled via a roller 21 (preferably provided with ball bearings) to the extended end 22 of the support lever 11. The roller is mounted on the extension piece 3.

The stretching of the strings produces a tension force which is transmitted via the ribbon 20 to the support lever 11. The support lever 11 transmits the tension force to the tension spring 23 which is mounted between the support lever 11 and the extension piece 3. The seat of the roller 21 and the tension spring 23 may be adjustable by adjusting screws 24 and 25 so that a fine unoperated or normal rest position of the whole device can be adjusted. The spring can be dampened by dampening materials in order to prevent a self-acting oscillation of the spring and the whole system. The seat of the ribbon 20 at the extended end 22 of the support lever 11 can also be constructed as a continuously adjustable seat with an adjusting screw 26, so that the transmission ratio of "string-tension-force" and "sliding-force" can be regulated as wanted.

The stringholder has at least one winding piece (for all strings) or preferably several winding pieces 27 (one for each string) which are mounted on the axle 14. These winding pieces 27 may have different diameters when there is one winding piece for each string. When it is one piece for all strings, this piece will have one groove for each string. The grooves may have different depths. The different diameters present different lever arms for the strings which are wound round the winding pieces 27 and are fixed by hanging them in the pins 25. Different lever arms can compensate a different degree or force of tension and stretching, so that the tuning of the strings, that means the pitch differences or intervals among one another, is guaranteed when sliding the neck. If the player intends to use other stringsets as before, he can exchange the winding pieces and use others which will have the perfect applicability for the special strings. For an excellent functioning, all moving parts of the device for pitch variation must have a frictional resistance as small as possible. The use of ball-bearings provides a very small frictional resistance. This small friction has the effect that the weight of the neck and its means produces a self-acting movement of the neck when the instrument is held in a sloping or inclined posture, which always happens during normal playing.

The first suitable action to be taken is to diminish the weight of the neck and its means as much as possible. Light materials such as light metal and light proportioning of all parts of the device have to be done. As a second action the installation of a counterweight can be used. This counterweight has to compensate completely the weight of the neck, that means, the albebraic sum of the neck's torque and the counterweight's torque must be zero.

The counterweight 29 is mounted on a third support lever 30. This support lever 30 is flexibly fixed in the bearing 9. The bearing 9 is preferably constructed as a ball-bearing and is mounted on the extension of the bar 6. Its motion plane is also parallel on the bottom of the body. For a bigger range of motion the counterweight moves in a lower level. The second extended end 31 of the support lever 11 is connected with the support lever 30 by a push rod 32.

The connection is so formed that an inversion of the movements is provided. The transmission ratio is chosen so that the inertial mass of the counterweight is small enough for good functioning. The connection-bearings 33 and 34 on the two support levers are preferably constructed as ball-bearings. It should be understood that other driving-means also can be used, for instance, traces or ribbons turned round by rollers. A second tension spring 35 can be installed for better driving of the counterweight 29. This tension spring 35 is fixed between counterweight 29 and the bottom of the body 2. Its seat 36 can be adjusted by an adjusting screw, for a fine normal position of the device.

In some situations of playing it is desired that the neck is fixed (not slidable) for an easier handling and playing of very fast notes and complicated chord changes, for example.

The locking and opening of the neck has to be done quickly when playing without interrupting the continuation of music. The locking device consists of a swivel-mounted lock-piece 37 which can be pushed into a corresponding space or gap between two rollers 38 and 39, or means similar to this, by the player's action.

The lock-piece 37 may be mounted on a forked lever 40, which is flexibly fixed on the bar 6. An adjusting screw allows adjustment of the proper position of the lock-piece at the normal position or rest position of the whole device for pitch variation. The rollers are preferably mounted on the extension piece 3. When the lock-piece 37 is pushed between the two rollers 38 and 39, sliding or swinging of the neck is not possible any more, so that the neck is locked. The driveing means by which the player can move the lock-piece can be thus constructed that a lever-plate 41 is pivoted mounted on the lower side of the bottom of the body 2. A rod 42 connects the lever-plate 41 and the forked lever 40. A spring 43 holds the normal position of the forked lever 40. This normal position can be so chosen that the neck is normally opened. When the player presses the instrument against his own body, done by the left hand, the lever-plate 41 will be moved and the lock-piece 37 goes into lock-position. When the player unburdens the lever-plate 41 the spring 43 pulls the lock-piece 37 out of lock position. For a perfect function the said means can be helped by a common tipping device.

The normal position can (on the other hand) just so be chosen that the neck is normally locked. Then the driving of the lock-piece 37 functions vice versa. It should be understood that other driving-means also can be used. So the player may drive the lock-piece 37 by pushing down a pedal with his foot, whereby pedal and forked lever 40 can be connected by a cable (Bowden). Furthermore a simple lever-plate for the right hand can be installed on the top-side of the body of the instrument, by which the forked-lever 40 may be moved.

The main advantages of the invention are:

- A very smooth sliding or swinging of the neck, with a perfect self-actioned replacing into the normal position.
- A simple mechanism which is easily to produce.
- A perfect and stabilized tuning effected by counterweight.
- A usual sound (locked neck) and the new sound effects (opened neck) selectable by the player when playing.

While the invention has been described, it will be understood that it is capable of further modifications and this application is intended to cover any variations, uses, or adaptations of the invention following in general, the principles of the invention and including such departures from the present disclosure as come within known or customary practice in the art to which the invention pertains, and as may be applied to the essential features hereinbefore set forth and as fall within the scope of the invention or the limits of the appended claims.

What is claimed is:

1. A stringed musical instrument comprising a body having a bottom, support lever means mounted for pivotal movement substantially in a plane parallel to said bottom, a neck and an extension piece thereof supported by said support lever means, to connect said extension in movable relation to said body, stringholder means carried by said neck extension piece, strings attached to said stringholder means, and means responsive to pivotal movement of said support lever means for varying the tension of said strings.

2. An instrument as in claim 1, wherein said stringholder means includes a rotary axle, and said means for varying the tension of the strings includes means responsive to pivotal movement of said lever means for turning said axle.

3. An instrument as in claim 1, further comprising a counterweight operatively connected to said support lever means.

4. An instrument as in claim 3, further comprising a tension spring operatively connected between said counterweight and said body.

5. An instrument as in claim 1, further including the features that:

a. said support lever means includes a plurality of support levers,
b. said stringholder means includes a rotary axle having a lever arm connected thereto,
c. a ribbon connects one support lever to said lever arm,
d. said axle has bearings fixed on said extension piece,
e. interchangeable winding members with compensating diameters are mounted on said axle.

6. An instrument as in claim 1, further including the features that:

a. said support lever means includes a plurality of support levers,
b. said neck extension piece is mounted on two main support levers,
c. a counterweight is mounted on a third support lever, said third lever also being mounted for movement substantially in a plane parallel to said bottom, d. push rod means connecting said third lever to one of said main support levers in such a way that pivotal movement of said third lever in one direction will cause pivotal movement of said main levers in an opposite direction, e. a first tension spring acting between said neck extension piece and one of said main levers, and f. a second tension spring acting between said body and said counterweight.

7. An instrument as in claim 6, further including the features that:

a. said first and second tension springs have adjustable seats, b. there is a forked lever, c. a lock piece is adjustably mounted on said forked lever, d. two rollers with openings for said lock piece are mounted on said extension piece, e. a spring holds said forked lever, f. a plate lever is movably mounted on the lower side of said bottom of said body of the instrument, g. said plate lever is positioned to lie against the body of the player of the instrument during the playing thereof, and h. means operatively connecting said plate lever to said forked lever to cause said plate lever to move said forked lever when said plate lever is moved as a result of firm pressure against the body of the player.

* * * * *

UNITED STATES PATENT AND TRADEMARK OFFICE

CERTIFICATE OF CORRECTION

PATENT NO. : 4,137,812
DATED : February 6, 1979
INVENTOR(S) : Rainer Franzmann

It is certified that error appears in the above-identified patent and that said Letters Patent are hereby corrected as shown below:

On the cover sheet, in item 30, Foreign Application Priority Data, for "Oct. 8, 1976" read --Aug. 10, 1976--.

for both occurrences of "Apr. 2, 1977" read --Feb. 4, 1977--.

Signed and Sealed this

*First* Day of *May 1979*

[SEAL]

*Attest:*

RUTH C. MASON
*Attesting Officer*

DONALD W. BANNER
*Commissioner of Patents and Trademarks*